US007768368B2

(12) United States Patent
Muffler et al.

(10) Patent No.: US 7,768,368 B2
(45) Date of Patent: Aug. 3, 2010

(54) ELECTROMAGNETIC ACTUATING APPARATUS

(75) Inventors: David Muffler, Meßkirch (DE); Volker Knies, Mühlingen-Zoznegg (DE); Ingo Bauerschmidt, Shanghai (CN)

(73) Assignee: ETO Magnetic GmbH, Stockach (DE)

( * ) Notice: Subject to any disclaimer, the term of this patent is extended or adjusted under 35 U.S.C. 154(b) by 69 days.

(21) Appl. No.: 12/061,197

(22) Filed: Apr. 2, 2008

(65) Prior Publication Data

US 2008/0246570 A1 Oct. 9, 2008

(30) Foreign Application Priority Data

Apr. 4, 2007 (DE) ..... 20 2007 005 132 U

(51) Int. Cl.
*H01H 51/22* (2006.01)
*H01F 7/00* (2006.01)
*H01F 5/00* (2006.01)
*H01F 7/08* (2006.01)

(52) U.S. Cl. ..... 335/278; 335/282; 335/82

(58) Field of Classification Search ..... 335/282, 335/278, 83

See application file for complete search history.

(56) References Cited

U.S. PATENT DOCUMENTS 3,551,862 A * 12/1970 Haug ..... 335/260
4,896,126 A * 1/1990 Siepmann ..... 335/244
5,204,044 A * 4/1993 Yoneshige ..... 264/272.15
5,358,215 A * 10/1994 Buth et al. ..... 251/129.21
5,710,535 A * 1/1998 Goloff ..... 336/192
5,860,632 A * 1/1999 Buth et al. ..... 251/129.15
6,118,361 A * 9/2000 Ogawa ..... 336/96
6,121,865 A * 9/2000 Dust et al. ..... 336/96
6,784,778 B2 * 8/2004 Stitz et al. ..... 336/90
6,848,919 B2 * 2/2005 Stitz et al. ..... 439/130
7,151,427 B2 * 12/2006 Muller et al. ..... 335/278
2004/0089833 A1 * 5/2004 Muller et al. ..... 251/129.15
2004/0104795 A1 * 6/2004 Stitz et al. ..... 336/65

* cited by examiner

*Primary Examiner*—Elvin G Enad
*Assistant Examiner*—Alexander Talpalatskiy
(74) *Attorney, Agent, or Firm*—Bachman & LaPointe, P.C.

(57) ABSTRACT

The invention relates to an electromagnetic actuating apparatus with an armature unit, which is guided axially in a housing and is capable of being moved by means of energizing a coil apparatus, contact plug means, which are held in an insulator unit, being associated with the coil apparatus, and an elongated ground contact of the contact plug means being electrically conductively connected to the housing, and the ground contact interacting electrically conductively at an engagement end which is opposite its free end with a yoke section, which is associated with the housing preferably at the front end, in such a way that, in a fitted state, a cutout formed in the engagement end in the ground contact engages over a projection of the yoke section and/or at least partially surrounds it.

28 Claims, 2 Drawing Sheets

ELECTROMAGNETIC ACTUATING APPARATUS

BACKGROUND

The present invention relates to an electromagnetic actuating apparatus in accordance with the preamble of the main claim. Such an apparatus is known from DE 101 19 939 A1 (U.S. Pat. No. 6,848,919 B2). The disclosure of DE 101 19 939 A1 is incorporated by reference in its entirety herein as if set forth at length.

This known apparatus is complex in terms of the way in which contact is made with the ground contact and the way in which it is sealed, with the result that there is need for improvement in particular from the point of view of suitability for mass production and ease of fitting.

The object of the present invention is therefore to improve the ease of fitting and contact-making for the generic apparatus.

SUMMARY

The present invention is achieved by the apparatus according to the features of the independent claims; advantageous developments of the invention are described in the dependent claims. The connection with the prior art selected as being of the generic type in accordance with DE 101 19 939 A1, in particular the overall context with reference to FIGS. 1 and 2, is also claimed as belonging to the invention (if there is no contradiction to the following description), in the same way as the features resulting from the following discussion relating to FIGS. 1 to 6.

Thus, the invention makes simple production (for example stamping of the contact) and fitting (simple plugging-in and snapping) possible as a result of the (unbent) strip-shaped configuration of the ground contact in conjunction with a slot which can be formed easily in the insulator; the problems associated with sealing are solved either by means of (for example liquid) sealing means to be introduced into the slot, in addition or as an alternative by means of a sealing element to be inserted.

As a result, the present invention in a surprisingly simple and elegant manner provides a way of making it possible to significantly improve advantageous generic electromagnetic actuating apparatuses in particular from manufacturing and fitting points of view.

BRIEF DESCRIPTION OF THE DRAWINGS

Further advantages, features and details of the invention result from the description below relating to preferred exemplary embodiments and with reference to the drawings, in which.

DETAILED DESCRIPTION

Figure 1:
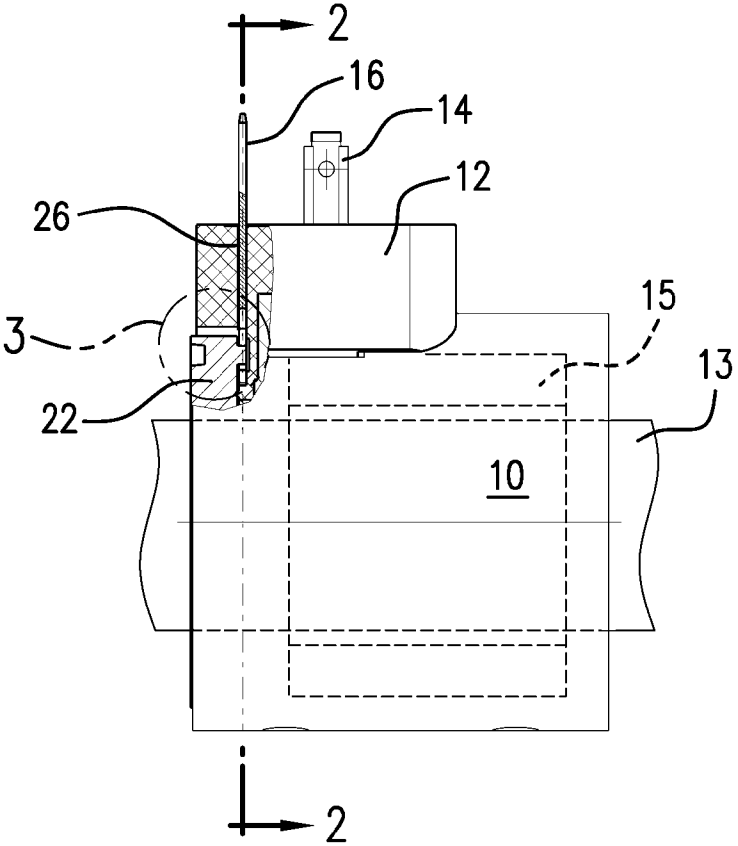

As is shown in the partially sectioned side view in FIG. 1, an electromagnetic actuating apparatus has a housing body 10, on which an insulating section 12 for forming a contact plug unit rests. The body 10 carries a guide tube 11 having a central inner diameter (ID) passageway for accommodating an armature assembly 13. In addition to a contact pair 14 for the coil apparatus (e.g., coil-on-spool) 15 in the housing 10, the contact plug unit has a ground contact plug (ground contact) 16 in the form of a strip-shaped/elongated stamped part, which at one end forms a free end (for electrical contact-making externally), and at the other end a fork-shaped engagement section 18 (FIG. 2) for interacting with a projection (tab) 20 of a disk-shaped yoke flange 22 of the arrangement shown in FIG. 1. The coil is energizable via the contacts to longitudinally/axially shift the armature. The shift may be against a single or bi-directional restoring spring bias.

Figure 3:
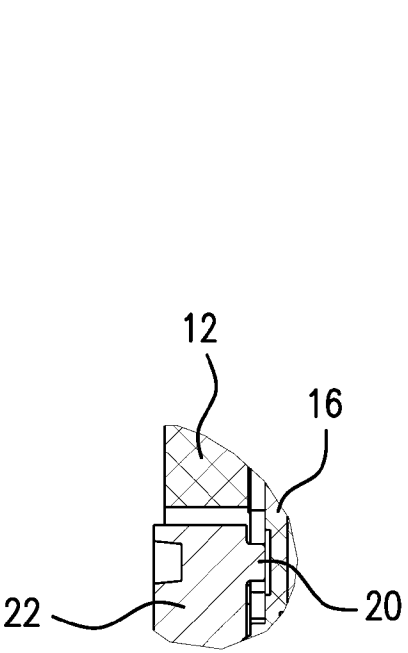
FIGS. 1 to 3 show a side view with a partial section, a front-end sectional view and an enlarged detail for illustrating a first embodiment of the present invention.
Figure 2:
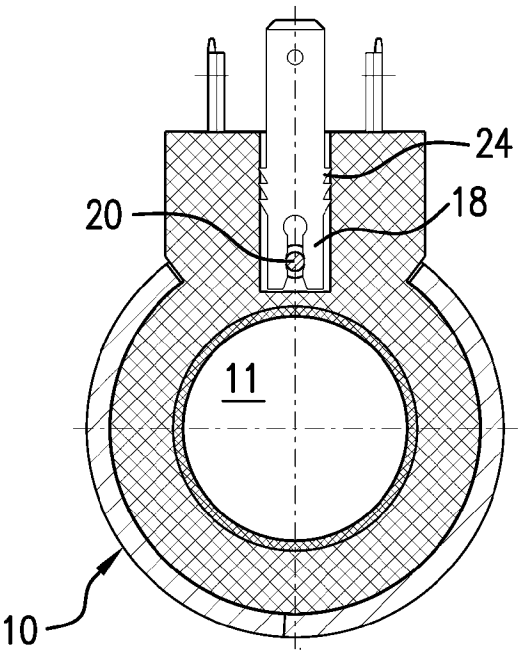
Figure 6:
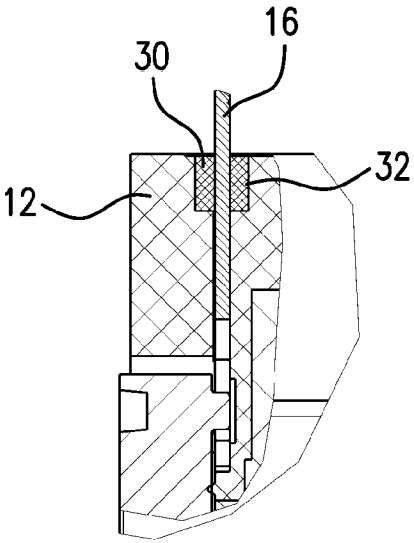
FIGS. 4 to 6 show a side view with a partial section, a front-end sectional view and an enlarged detail for illustrating a second embodiment of the present invention.

In more precise terms, and in particular with reference to the sectional view in FIG. 2 and the detail of FIG. 3, it is shown that, in the exemplary embodiment shown, the fork-shaped engagement region 18 forms a pair of free tongues, which at least partially surround (or touch; in the context of the present invention the contact-making on both sides shown in FIG. 2 is also "surrounding" in this sense) the cylindrical (pin-shaped) projection 20 (shown projecting from an inboard axial face of the yoke flange 22). FIG. 6 shows the projection 20 as unitarily formed with a remainder of the yoke as a single piece. The fork tongues define (are separated by a recess/channel/slot which accommodates the projection. The recess has a beveled/convergent mouth to guide the projection during insertion of the ground contact and facilitate a lateral gripping of the projection by the tongues when installed.

This not only simplifies the manufacture of the element 16 significantly (simple stamping without any bending operation being required), but also the fitting takes place by means of insertion or simple snapping-in, barbs 24 formed in the lateral region of the stamped part 16 preventing unintentional sliding-out of the contact lug 16. The recess may have a widened area to detent the projection in the installed/inserted condition.

Sealing of the ground contact arrangement against the unintentional ingress of moisture, dust or the like takes place in the exemplary embodiment in FIGS. 1 to 3 by virtue of the introduction of liquid sealing means 26 into the slot.

Figure 5:
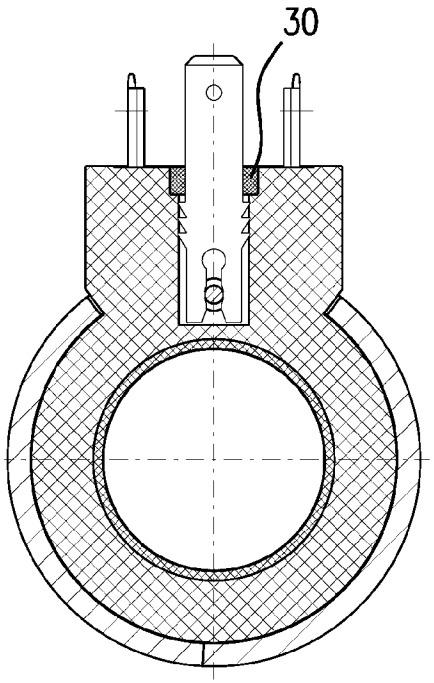
Figure 4:
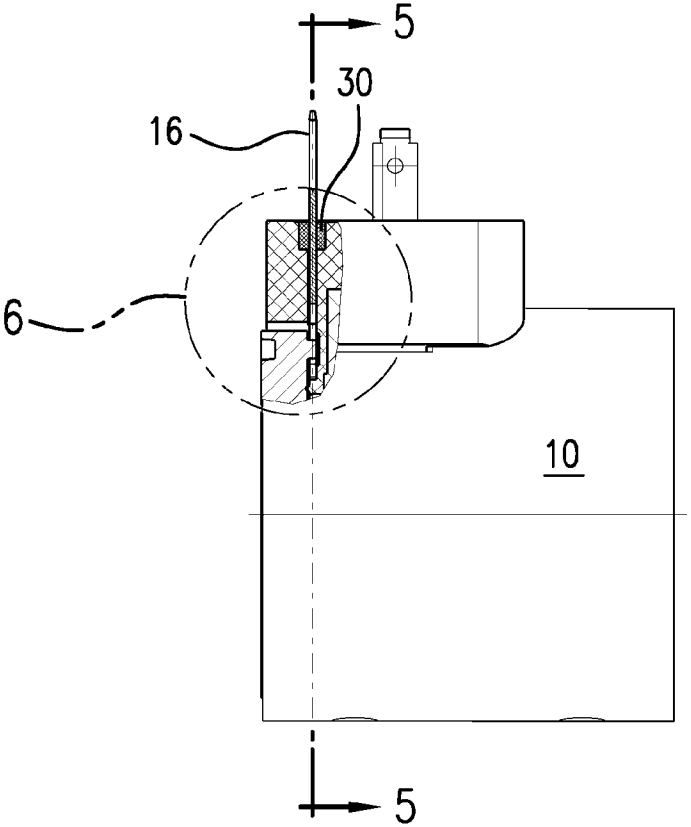

The second exemplary embodiment in FIGS. 4 to 6 corresponds structurally and functionally virtually identically to the above-described exemplary embodiments; components which have not been provided with reference symbols or which have been provided with identical reference symbols correspond directly to the first exemplary embodiment. As can be seen in particular from the sectional view of FIG. 6 (detail from FIG. 4), in this exemplary embodiment a sealing body (element) 30 is additionally inserted into the insulator 12 into a corresponding end-side cutout 32, however, in such a way that suitable rubber or silicone sealing material surrounds the contact 16 in sealing fashion.

What is claimed is:

1. Electromagnetic actuating apparatus with an armature unit, which is guided axially in a housing (10, 22, 11) and is capable of being moved by means of energizing a coil apparatus held on a spool, contact plug means (14, 16), which are held in an insulator unit (12), being associated with the coil apparatus, and an elongated ground contact (16) of the contact plug means being electrically conductively connected to the housing, characterized in that the housing comprises:

a housing body (10);

a yoke section (22) at a front end of the housing body; and a guide tube (11) carried by the housing body and having a central passageway accommodating an armature assembly (13); and the ground contact interacts electrically conductively at an engagement end which is opposite its free end with said yoke section in such a way that, in a fitted state, a cutout formed in the engagement end in the ground contact engages over a projection (20) of the yoke section and/or at least partially surrounds it.

2. Apparatus according to claim 1, characterized in that the engagement end of the ground contact is designed so as to open in the form of a fork in such a way that the ground contact can be pushed in a sprung and/or snap-action manner on or over the projection.

3. Apparatus according to claim 1, characterized in that the strip-shaped ground contact is a stamped part, and is guided in a slot formed in the insulator unit.

4. Apparatus according to claim 3, characterized in that the slot has sealing means, which acts between the insulator unit and the stamped part and prevents foreign substances from entering from the direction of the free end.

5. Apparatus according to claim 4, characterized in that the sealing means has a sealing element, which can be inserted into the insulator unit at the edge.

6. Apparatus according to claim 5, characterized in that the sealing element is a silicone and/or rubber seal surrounding the ground contact.

7. Apparatus according to claim 1, characterized in that the projection (20) is formed out of a ferromagnetic yoke element (22), at least sections of which are disk-shaped and/or ring-shaped.

8. Apparatus according to claim 7, characterized in that the projection is cylindrical and is designed to interact with a cutout, which is circular in sections, in the engagement end of the ground contact.

9. Apparatus according to claim 1, characterized in that the ground contact has barb means (24) on a narrow edge side which make it more difficult to withdraw the ground contact in the state in which it is inserted into the insulator unit.

10. Apparatus according to claim 1, characterized in that the apparatus is in the form of a water-tight and/or pressure-tight hydraulic or pneumatic magnet.

11. Electromagnetic actuating apparatus comprising:

a housing (10, 22, 11);

an armature unit (13), which is guided axially in the housing (10, 22, 11);

a coil apparatus (15) energizable to shift the armature unit; and contact plug means (14, 16), which are held in an insulator unit (12), being associated with the coil apparatus a ground contact (16) of the contact plug means being electrically conductively connected to the housing, wherein1 the housing comprises:

a housing body (10);

a yoke section(22) at a front end of the housing body; and a guide tube (11) carried by the housing body and having a central passageway accommodating the armature unit (13); and the ground contact interacts electrically conductively at an engagement end which is opposite its free end with said yoke section in such a way that, in a fitted state, a cutout formed in the engagement end in the ground contact engages over a projection (20) of the yoke section and/or at least partially surrounds it.

12. The apparatus of claim 11 wherein:

the projection is integrally formed with an annular flange of the yoke as a single piece.

13. The apparatus of claim 11 wherein:

the ground contact comprises an unbent stamping.

14. An electromagnetic actuating apparatus comprising:

a housing (10, 22, 11) comprising:

a housing body (10);

a yoke (22) at a front end of the housing body; and a guide tube (11) carried by the housing body and having a central passageway accommodating an armature unit (13);

a coil apparatus (15) within the housing;

an insulator unit (12); and plug contacts (14, 16) which are held partially in the insulator unit, each contact having a free end protruding from the insulator, and including:

a pair of contacts (14) being associated with the coil apparatus; and a ground contact (16) being electrically conductively connected to the housing;

wherein the yoke has:

a projection (20), the ground contact electrically coupled at an engagement end which is opposite its free end with the projection in such a way that, in a fitted state, a recess formed in the engagement end of the ground contact engages the projection.

15. The apparatus of claim 14 further comprising:

an armature unit (13), which is guided axially in the housing (10, 22, 11), the coil apparatus energizable via the pair of contacts to axially shift the armature unit.

16. An electromagnetic actuating apparatus comprising:

a housing (10, 22, 11);

a coil apparatus (15) within the housing;

an insulator unit (12); a guide tube (11) carried by a body of the housing and having a central passageway accommodating an armature assembly (13);

plug contacts (14, 16) which are held partially in the insulator unit, each contact having a free end protruding from the insulator, and including:

a pair of contacts (14) being associated with the coil apparatus; and a ground contact (16) being electrically conductively connected to the housing; and a yoke (22), which is associated with the housing at an end of the housing, the yoke having:

a projection (20), the ground contact electrically coupled at an engagement end which is opposite its free end with the projection in such a way that, in a fitted state, a recess formed in the engagement end of the ground contact engages the projection, wherein:

the engagement end of the ground contact in the form of a fork defining the recess and shaped so that the ground contact can be installed via insertion via a sprung and/or snap-action manner of the fork on or over the projection.

17. The apparatus of claim 16 wherein:

the ground contact comprises a flat stamping having barbs (24) on a pair of narrow edge sides oriented to preferentially make it more difficult to withdraw the ground contact.

18. The apparatus of claim 16 wherein:

the ground contact is captured in a slot formed in the insulator unit;

the slot has sealing means for acts between the insulator unit and the ground contact and preventing foreign substances from entering from the direction of the ground contact free end.

19. The apparatus of claim 18 wherein:

the sealing means has a sealing element inserted into the insulator unit at an edge of the insulator.

20. The apparatus of claim 19 wherein:

the sealing element is a silicone and/or rubber seal surrounding the ground contact.

21. An electromagnetic actuating apparatus comprising:

a housing (10, 22, 11);

a coil apparatus (15) within the housing;

an insulator unit (12); a guide tube (11) carried by a body of the housing and having a central passageway accommodating an armature assembly (13);

plug contacts (14, 16) which are held partially in the insulator unit, each contact having a free end protruding from the insulator, and including:

a pair of contacts (14) being associated with the coil apparatus; and a ground contact (16) being electrically conductively connected to the housing; and a yoke (22), which is associated with the housing at an end of the housing, the yoke having:

a projection (20), the ground contact electrically coupled at an engagement end which is opposite its free end with the projection in such a way that, in a fitted state, a recess defined by a fork in the engagement end of the ground contact engages the projection.

22. An electromagnetic actuating apparatus comprising:

a housing (10, 22, 11);

a coil apparatus (15) within the housing;

an insulator unit (12); a guide tube (11) carried by a body of the housing and having a central passageway accommodating an armature assembly (13);

plug contacts (14, 16) which are held partially in the insulator unit, each contact having a free end protruding from the insulator, and including:

a pair of contacts (14) being associated with the coil apparatus; and a ground contact (16) being electrically conductively connected to the housing; and a yoke (22), which is associated with the housing at an end of the housing, the yoke having:

a projection (20) projecting from an axial face of the yoke and unitarily formed with a remaining portion of the yoke.

23. A method for manufacturing the apparatus of claim 14, the method comprising:

inserting the ground contact so that the recess snaps over the projection; and sealing the ground contact.

24. The method of claim 23 wherein the insertion causes lateral barbs in the ground contact to prevent the ground contact from unintentional sliding out from the insulator unit.

25. An electromagnetic actuating apparatus comprising:

a housing (10, 22, 11); comprising; a housing body (10); a yoke (22) at an end of the housing body and having a projection (20); and a guide tube (11) carried by the housing body and having a central passageway accommodating an armature assembly (13);

a coil apparatus (15) within the housing;

an insulator unit (12);

plug contacts (14, 16) which are held partially in the insulator unit, each contact having a free end protruding from the insulator, and including:

a pair of contacts (14) being associated with the coil apparatus; and a ground contact (16) being electrically conductively connected to the housing and having a second end opposite the free end, the second end in the form of a fork defining a recess, the ground contact electrically coupled to the projection by engagement of the projection in the recess.

26. The apparatus of claim 25 wherein the ground contact is unbent and has barbs along edges.

27. An electromagnetic actuating apparatus comprising:

a housing body (10);

a coil apparatus (15) within the housing body;

an insulator unit (12); a guide tube (11) carried by a body of the housing and having a central passageway accommodating an armature assembly (13);

plug contacts (14, 16) which are held partially in the insulator unit, each contact having a free end protruding from the insulator, and including:

a pair of contacts (14) being associated with the coil apparatus; and a ground contact (16) having a second end opposite the free end, the second end in the form of a fork defining a recess; and a yoke (22) having:

a projection (20), the ground contact recess engaging the projection to electrically conductively connect the ground contact to the housing.

28. An electromagnetic actuating apparatus comprising:

a housing (10, 22, 11);

a coil apparatus (15) within the housing;

an insulator unit (12); a yoke (22) at an end of the housing body and having a projection (20); a guide tube (11) carried by a body of the housing and having a central passageway accommodating an armature assembly (13); and plug contacts (14, 16) which are held partially in the insulator unit, each contact having a free end protruding from the insulator, and including:

a pair of contacts (14) being associated with the coil apparatus; and a ground contact (16) having a second end opposite the free end, the second end in the form of a fork defining a recess receiving said projection to electrically couple the ground contact to the housing.

* * * * *